United States Patent [19]

Kroker et al.

[11] Patent Number: 5,063,261

[45] Date of Patent: Nov. 5, 1991

[54] SIZE FOR CARBON FIBERS AND GLASS FIBERS

[75] Inventors: Joerg Kroker, Neustadt; Silvio Vargiu, I-Casatenovo, both of Italy

[73] Assignee: BASF Aktiengesellschaft, Ludwigshafen, Fed. Rep. of Germany

[21] Appl. No.: 510,474

[22] Filed: Apr. 18, 1990

[30] Foreign Application Priority Data

Apr. 21, 1989 [DE] Fed. Rep. of Germany ..... 3913145

[51] Int. Cl.[5] ..... C08L 63/02

[52] U.S. Cl. ..... 523/402; 523/403; 523/407; 523/408; 523/410; 523/428; 523/502; 525/438; 525/445; 525/449; 525/450; 428/288; 428/290; 428/291; 428/375; 428/378; 428/395; 428/431; 528/272; 528/297; 528/300; 528/308

[58] Field of Search ..... 523/402, 403, 407, 408, 523/410, 428, 502; 525/438, 445, 449, 450; 428/288, 290, 291, 375, 378, 431, 395; 528/272, 297, 300, 308

[56] References Cited

U.S. PATENT DOCUMENTS

| | | | |
|---|---|---|---|
| 4,073,762 | 2/1978 | Hosoda et al. | 523/403 |
| 4,104,223 | 8/1978 | Hosoda et al. | 523/402 |
| 4,167,538 | 9/1979 | Taniguchi et al. | 525/438 |
| 4,420,512 | 12/1983 | Ogawa et al. | 427/386 |
| 4,517,245 | 5/1985 | Spain | 428/367 |
| 4,904,818 | 2/1990 | Minami et al. | 560/85 |

FOREIGN PATENT DOCUMENTS 0295916 6/1988 European Pat. Off. .

*Primary Examiner*—John Kight, III
*Assistant Examiner*—Sam A. Acquah
*Attorney, Agent, or Firm*—William G. Conger

[57] ABSTRACT

A size for carbon fibers and glass fibers comprises an epoxy resin and a polyester with a hydrophilic and a hydrophobic moiety in the molecule.

7 Claims, No Drawings

SIZE FOR CARBON FIBERS AND GLASS FIBERS

The present invention relates to a size for carbon fibers and glass fibers on the basis of an aqueous dispersion of an epoxy resin and an emulsifier.

The present invention relates in particular to a size composition which improves the processing properties —fiber bundle cohesion, bundling, spreadability, fluff formation resistance, fiber smoothness and softness, abrasion resistance and easy and nondestructive unwindability of the usually bobbined carbon or glass fiber bundles—as well as the physical properties of the composite containing the fibers treated therewith.

The fact that carbon fibers combine excellent mechanical properties, such as high tensile strength and high modulus of elasticity, on the one hand, and lightness, high heat resistance and chemical resistance on the other has been responsible for the increased use of these materials as reinforcing elements in composite materials for a wide range of applications in the aerospace industry, transportation or sports goods. In particular carbon fiber reinforced plastics (CRPs); the matrices of which are two-component resins such as epoxy resin, bismaleimide resins, unsaturated polyester resins or cyanate resins, are preferred for the aforementioned purposes.

Carbon fibers come in the form of bundles comprising from several hundred to one hundred thousand individual filaments from 5 to 20 μm in diameter, from 1,000 to 7,000 MPa in tensile strength and from 200 to 700 GPa in modulus of elasticity.

It is customary to produce carbon fibers by subjecting a suitable polyacrylonitrile, pitch or rayon fiber to varying controlled conditions of temperature and atmosphere. For example, carbon fibers can be produced by stabilization of PAN filaments or fabrics in an oxidative atmosphere from 200° to 300° C. and subsequent carbonization in an inert atmosphere above 600° C. Such processes are state of the art and described for example in H. Heissler, Verstärkte Kunststoffe in der Luft- und Raumfahrt, Verlag W. Kohlhammer, Stuttgart, 1986.

Optimal properties are only obtained if integral adhesion between the matrix material and the reinforcing fiber is ensured over a wide range of different temperature and moisture conditions.

To achieve this, the carbon fibers are subjected to an oxidative surface treatment and then provided with a suitable sizing agent. Glass fibers, by contrast, are quenched on emergence from the spinneret by spraying with water and then provided with the sizing agent by passing them over a rotating roll, before the individual filaments are bundled together as rovings which are wound up in cake form and then dried in an oven.

The size has many purposes; on the one hand, it is supposed to protect the very fragile filaments which make up the fiber bundle—and hence the fiber bundle per se—from mechanical damage during handling and during the particular treatment process and preserve good handleability and processing properties even following prolonged storage of the continuous fiber bundles under varying conditions of temperature and moisture on close wound bobbins, and on the other it is supposed to ensure uniformly good wetting of the fibers by the matrix material during the composite material fabrication process. Furthermore, the size must as a whole be chemically compatible with the particular matrix material to make it possible to produce qualitatively high-grade and durable composite materials. Even exposure of the composite to continuously varying conditions of temperature and moisture should not give rise to any delamination processes resulting from incompatibilities and absorption of moisture To meet some or all of the requirements mentioned, a wide variety of sizing agents have been proposed for carbon fibers and glass fibers.

The emerging preference for epoxy resins as the basis of many sizing agents especially for the carbon fibers is probably due to the fact, on the one hand, that in general epoxy resins are used as matrices for producing CRPs, so that size/matrix incompatibilities are hardly likely, and on the other because of the relatively high and hence nonspecific chemical reactivity of the oxirane ring toward a wide range of functional groups, making it also possible to use resins other than epoxy resins as matrix in CRPs.

Generally, sizing agents for carbon fibers can be divided into 2 types, the solvent and the emulsion type. With the solvent type, the polymer, which is usually a resin, is in solution in a low-boiling organic solvent and is applied to the fibers from dilute solution. With the second type, the emulsion type, the resins are dispersed in water with the aid of dispersants or emulsifiers, as they will be called hereinafter. Safety aspects relating to toxicity and flammability are the reason why the emulsion type is clearly preferable.

A size of the emulsion type is applied to a carbon fiber by continuously passing the fiber bundle through the dilute aqueous dispersion having a solids content of from 1 to 10% by weight and the fiber is immediately thereafter dried and wound onto bobbins for transport and storage or sent directly for further processing; the polymer content of the fiber thus treated is then about 0.5–7% by weight.

Especially very dilute aqueous dispersions of very viscous non-self-emulsifying epoxy resins tend to show low emulsion stability, the reasons being large particle diameters and chemically incompatible and/or low molecular weight emulsifiers.

The amount of emulsifier required increases with increasing fineness of the epoxy resin, ie. proportionally with the increase in surface area of dispersed particles. Uniform size application to the filaments making up the fiber bundle requires a very finely divided dispersion, so that the particles can easily penetrate into the center of the bundle.

According to DE-A-3 436 211, the emulsifier used should be a block copolymer of polyethylene oxide and polypropylene oxide of the schematic formula $$HO\left(CH_2CH_2O\right)_x\left(\underset{\substack{|\\ CH_3}}{CH}CH_2O\right)_y\left(CH_2CH_2O\right)_x H$$

However, epoxy resin sizes based on such emulsifiers have considerable disadvantages. On the one hand, the film forming properties of these dispersions are only moderate, and on the other laminates produced from an epoxy resin as matrix and carbon fibers treated with these size dispersions show an increased moisture regain which causes delamination phenomena and hence leads to a low mechanical strength of these composites under hot and moist conditions. This is probably because this emulsifier has 80% by weight of terminating hydrophilic aliphatic groups, namely polyethylene oxide, and 20% by weight of hydrophobic aliphatic groups, namely polypropylene oxide; the dried size proves to be extremely hygroscopic. Another factor is the unsatisfactory chemical compatibility of these aliphatic emulsifiers with the hydrophobic, predominantly aromatic nature of the epoxy resins.

DE-A-2 746 640 and EP-A-295 916 describe sizes for carbon fibers, consisting of an aqueous dispersion of a mixture of a) an epoxy resin b) a polyester of an unsaturated dicarboxylic acid and an alkoxylated bisphenol and c) an emulsifier comprising an oxyalkylene derivative of a phenol.

Such dispersions do not show sufficient stability to storage, nor do they have adequate film forming properties when very dilute; nor are they capable of providing adequate and uniform emulsification of very fine epoxy resin particles.

It is an object of the present invention to provide a sizing agent for treating carbon fibers and glass fibers which is free of organic solvents and hence safe as regards toxicity and flammability, which improves, and also lastingly preserves, the handleability and processing properties of the fiber bundles, and which exhibits very good chemical compatibility with the epoxy resin matrices over a wide range of temperature and moisture conditions and hence ultimately leads to improved mechanical properties of the composite materials prepared from an epoxy resin as matrix and sized carbon or glass fibers.

We have found that this object is achieved according to the present invention by a size containing an epoxy resin and from 5 to 50% by weight, based on the epoxy resin, of a polyester of the general formula $A_1$-B-$A_2$-B-$A_3$-H, where the symbols have the following meanings:

$A_1$ is the radical of a monoalcohol,

B is the radical of a dicarboxylic acid, $A_2$ is the radical of a diol and $A_3$ is the radical of a polyether diol, and the polyester has a molecular weight of from 5,000 to 50,000.

Preferably, the polyesters have a molecular weight of from 10,000 to 25,000.

$A_1$ has the structure $$R_1-O-(CH_2-\underset{\underset{R_2}{|}}{CH}-O)_n$$

where $R_1$ is aliphatic, aromatic or araliphatic hydrocyclyl of from 6 to 30 carbon atoms, $R_2$ is hydrogen or methyl and n is an integer from 0 to 30, B is the radical of a saturated or unsaturated, aliphatic, cycloaliphatic or aromatic dicarboxylic acid of from 2 to 20 carbon atoms, $A_2$ is the radical of a diol of from 10 to 60 carbon atoms which carries secondary OH groups, and $A_3$ is the radical of a polyether diol of the structure $X_p-Y_q-Z_r$ where $X=(CH_2-CH_2-O)$ $$Y=(CH_2-\underset{\underset{CH_3}{|}}{CH}-O)$$

$Z=(CH_2-CH_2-O)$ p=50–200 q=0–100 r=0–200, the radical X forming the chain end.

In a preferred embodiment of the present invention, the weight ratio $(A_1+B+A_2+Z+Y):X$ is from 80:20 to 40:60.

The basis is the finding that optimizing the ratio of hydrophobic to hydrophilic groups is pivotal for the emulsifier effect of the polyester. Evidently, however, it is only the polyethylene oxide groups X at the end of a chain which are hydrophilic but not the polypropylene oxide groups Y nor the nonterminal polyethylene oxide groups Z.

It appears to be a general rule that polyesters which make good emulsifiers have a molecular weight of from 5,000 to 50,000 and consist of a hydrophobic moiety M and a hydrophilic polyethylene oxide moiety X-H with the weight ratio M:X being within the range from 80:20 to 40:60, preferably from 70:30 to 50:50. A polyester having an M:X ratio greater than 80:20 no longer has a sufficient emulsifying effect on the epoxy resin; if the M:X ratio is less than 40:60, the size proves to be excessively hygroscopic.

To prepare the polyester emulsifier, it is preferable first to react one equivalent of the monoalkyl $A_1$—H with approximately one equivalent of the dicarboxylic acid H—B—H, or the anhydride thereof, to give the half-ester $A_1$—B—H by a conventional condensation reaction. In a further step, this half-ester is condensed with approximately one equivalent of the diol H—$A_2$—H or preferably of the corresponding diepoxide until the acid number has decreased to less than 1 mg of KOH/g. Finally, a further equivalent of the dicarboxylic acid H—B—H, or of the corresponding anhydride, and about 1 equivalent of the polyether diol H—$A_3$—H are added and condensed until the acid number has again decreased to below 1 mg of KOH/g.

A preferred monoalcohol $A_1$—H is octylphenoxypolyethoxyethanol having a molecular weight of about 640 or nonylphenoxypolyethoxyethanol having a molecular weight of about 615.

Preferred dicarboxylic acids H—B—H are tetrahydrophthalic acid, adipic acid, fumaric acid and maleic acid, but it is also possible to use for example itaconic acid, succinic acid, phthalic acid, isophthalic acid, terephthalic acid and also, where they exist, the anhydrides thereof.

The diols H—$A_2$—H are preferably used in the form of the corresponding diepoxides Preferred diepoxides are the diglycidyl ethers of bisphenols A and F having an epoxy equivalent weight of about 100–1000.

Preferred diols H—$A_3$—H are: a polyethylene oxide/polypropylene oxide/polyethylene oxide block copolymer having a molecular weight of about 14,000 and a corresponding block copolymer having a molecular weight of about 9,000 and also polyethylene oxide having a molecular weight of about 4,000.

The main constituent of the carbon fiber or glass fiber size according to the present invention is an epoxy resin. Suitable epoxy resins are the customary glycidyl ethers of mono- or polyfunctional, preferably aromatic, alcohols having epoxy equivalent weights of from 100 to 1500 g/eq. Preference is given to diglycidyl ethers of bisphenols A and F.

To prepare the size, preferably 100 parts by weight of epoxy resin are added together with from 5 to 40, in particular from 8 to 30, parts by weight of the emulsifier, heated and stirred to form a clear homogeneous melt. Thereafter sufficient water is added a little at a time with intensive stirring until a homogeneous oil-in-water emulsion forms which can then be diluted ad infinitum. The ready-prepared dispersion preferably has a solids concentration of from 1 to 10% by weight. This size is notable for the following properties: very finely divided dispersion of high storage stability, good film forming properties and excellent emulsion stability even when very dilute.

To apply the size according to the present invention to carbon fibers, they are pulled through the size dispersion and subsequently dried in a dry cell with hot air at 150° C. The size addon on the fiber should then be from 0.3 to 10% by weight, preferably from 0.5 to 2% by weight. The procedure for applying the size to glass fibers was described earlier.

In the Examples, the parts and percentages are by weight.

The Examples I to IX describe the preparation of polyesters with Examples I–V described in the preparation of emulsifiers according to the present invention.

Examples X to XXIII describe the preparation of epoxy resin dispersions with the emulsifiers of Examples I to V according to the present invention being used in X to XIV and XVI to XXI. Examples XV and XX to XXV are not according to the invention; the emulsifiers used therein were those prepared according to Examples VI to IX, ie. Pluronic L 31 and Pluronic F 108 from BASF Corp. which are not according to the present invention. A. Preparation of emulsifiers

EXAMPLE I

In a 6 l three-neck flask equipped with a vane stirrer, an internal thermometer, a reflux condenser and a protective gas supply ($N_2$), 1290 parts of octylphenoxypolyethoxyethanol having a molecular weight of about 640 g/mol (Triton X100 from Rohm & Haas) are admixed at 100° C. with 300 parts of tetrahydrophthalic anhydride by stirring. After the temperature has been increased to 160° C., stirring is continued at that temperature until the reaction mixture has an acid number of 70 mg of KOH/g. Thereafter 760 parts of a diglycidyl ether of bisphenol A having an epoxy equivalent weight of 190 g/eq (Epikote 828 from Shell) are added. After the temperature has been raised once more, to 180° C., the reaction mixture is stirred at that temperature for a further 2–4 hours until the acid number is <1 mg of KOH/g and the epoxy equivalent weight is about 1200 g/eq. The reaction mixture is then cooled to 140° C., and 28,000 parts of a polyethylene oxide/polypropylene oxide block copolymer of he approximate formula $$HO(CH_2CH_2O)_{128}(\underset{\underset{CH_3}{|}}{CH}CH_2O)_{54}(CH_2CH_2O)_{128}H$$

having a molecular weight, determined by vapor pressure osmometry, of 13,600 g/mol (Pluronic F108 from BASF Corp.) are added. After the temperature has been raised again, to 150° C., 300 parts of tetrahydrophthalic anhydride are added, the temperature is raised once more to 180° C., and the reaction mixture is left at that temperature, with stirring, until the acid number is <1 mg of KOH/g.

EXAMPLE II

Example I is then repeated, except that the octylphenoxyp-olyethoxyethanol used therein is replaced by 1,239 parts of nonylphenoxypolyethoxyethanol having a molecular weight of about 615 g/mol (Ethylan BCP from Lankro Chemicals Ltd.).

EXAMPLE III

Example I is repeated, except that the tetrahydrophthalic anhydride used on both occasions as the acid component in the reaction sequence of I is replaced at the start by 193 parts of maleic anhydride, added at 100° C., and then by 288 parts of adipic acid, added as the second acid component at 150° C.

EXAMPLE IV

Example I is repeated, except that the diglycidyl ether of bisphenol A having an epoxy equivalent weight from about 190 g/eq is replaced by 1800 parts of a diglycidyl ether of bisphenol A having an epoxy equivalent weight of about 475 g/eq (Epikote 1001 from Shell).

EXAMPLE V

Example I is repeated, except that the polyethylene oxide/polypropylene oxide block copolymer is replaced by 16,600 parts of a compound of similar structure having vapor pressure osmometry molecular weight of 9,700 g/mol (Pluronic F68 from BASF Corp.).

EXAMPLE VI (Comparison)

Example I is repeated, except that the polyethylene oxide/polypropylene oxide block copolymer is replaced by 2,200 parts of compound of similar structure having a vapor pressure osmometry molecular weight of 1,070 g/mol (Pluronic L31 from BASF Corp.).

EXAMPLE VII (Comparison)

Example I is repeated, except that the polyethylene oxide/polypropylene oxide block copolymer is replaced by 12,000 parts of a polyethylene oxide having a vapor pressure osmometry molecular weight of 6,200 g/mol (Pluriol E6000 from BASF AG).

EXAMPLE VIII (Comparison)

Example I is repeated, except that the polyethylene oxide/polypropylene oxide block copolymer is replaced by 800 parts of a polyethylene oxide having a vapor pressure osmometry molecular weight of 410 g/mol (Pluriol E 400 from BASF AG).

EXAMPLE IX (Comparison)

Example I is repeated, except that the polyethylene oxide/polypropylene oxide block copolymer is replaced by 400 parts of a polyethylene oxide having a vapor pressure osmometry molecular weight of 210 g/mol (Pluriol E200 from BASF AG).

B. Preparation of epoxy resin dispersions

EXAMPLE X 170 parts of a diglycidyl ether of bisphenol A having an epoxy equivalent weight of 190 g/eq (Epikote 828 from Shell), 368 parts of a diglycidyl ether of bisphenol A having an epoxy equivalent weight of 475 g/eq (Epikote 1001 from Shell) and 95 parts of an emulsifier as described in Example I are added together and heated to 70° C. and stirred to form a clear homogeneous melt. The heat supply is removed and the mixture is cooled down to 60° C. At this temperature 325 parts of deionized water are slowly added in the course of about 30 minutes while the resin melt/water system is intensively homogenized by means of a dissolver disk at a speed of 1500 rpm. The amount of water then added corresponds approximately to the resin/water ratio at which the water-in-oil emulsion turns into an oil-in-water emulsion. At this phase inversion point the temperature of the dispersion is still 45° C. Thereafter the speed of the dissolver disk is reduced to 200 rpm and a further 620 parts of deionized water are added to dilute the dispersion.

Properties of the resin melt preparation prior to the dispersing:

| | |
|---|---|
| Epoxy equivalent weight (potentiometric): | 390 g/eq |
| Brookfield viscosity at 60° C.: | 25,200 mPas |
| Glass transition temperature (DSC): | −3° C. |
| Properties of the resulting aqueous dispersion: | |
| Solids content: | 40% by weight |
| Particle size distribution (laser light scattering): | 90% < 2.3 μm<br>50% < 1.5 μm<br>10% < 1.2 μm |
| Gravimetric stability of the dispersion 24 h after dilution with deionized water to 3% solids: | 98.8% |
| Tyndall effect: | very pronounced |
| Appearance of a 15 μm thick film after drying: | clear, very bright |
| Minimum film forming temperature of dispersion: | 7° C. |

EXAMPLE XI

Example X is repeated, except that the emulsifier used therein is replaced by 95 parts of emulsifier prepared according to Example II. Properties of the resin melt preparation prior to the dispersing:

| | |
|---|---|
| Epoxy equivalent weight (potentiometric): | 388 g/eq |
| Brookfield viscosity at 60° C.: | 24,000 mPas |
| Glass transition temperature (DSC): | 0° C. |
| Properties of the resulting aqueous dispersion: | |
| Solids content: | 40.1% by weight |
| Particle size distribution (laser light scattering): | 90% < 2.4 μm<br>50% < 1.3 μm<br>10% < 0.6 μm |
| Gravimetric stability of the dispersion 24 h after dilution with deionized water to 3% solids: | 98.5% |
| Tyndall effect: | very pronounced |
| Appearance of a 15 μm thick film after drying: | clear, very bright |
| Minimum film forming temperature of dispersion: | 8° C. |

EXAMPLE XII

Example X is repeated, except that the resin melt preparation to be dispersed is composed of 100 parts of a diglycidyl ether of bisphenol A having an epoxy equivalent weight of 190 g/eq (Epikote 828 from Shell), 170 parts of a diglycidyl ether of bisphenol A having an epoxy equivalent weight of 475 g/eq (Epikote 1001 from Shell) and 265 parts of a diglycidyl ether of bisphenol A having an epoxy equivalent weight o 860 g/eq (Epikote 1004 from Shell) and 95 parts of the emulsifier prepared according to Example I.

Properties of the resin melt preparation prior to the dispersing:

| | |
|---|---|
| Epoxy equivalent weight (potentiometric): | 585 g/eq |
| Brookfield viscosity at 60° C.: | 190,000 mPas |

-continued

| | |
|---|---|
| Glass transition temperature (DSC): | 1° C. |
| Properties of the resulting aqueous dispersion: | |
| Solids content: | 40.2% by weight |
| Particle size distribution (laser light scattering): | 90% < 3.9 μm<br>50% < 1.6 μm<br>10% < 0.7 μm |
| Gravimetric stability of the dispersion 24 h after dilution with deionized water to 3% solids: | 99.2% |
| Tyndall effect: | pronounced |
| Appearance of a 15 μm thick film after drying: | clear, very bright |
| Minimum film forming temperature of dispersion: | 8–10° C. |

EXAMPLE XIII

Example XII is repeated, except that the amount of emulsifier in the resin melt preparation of 160 parts. Accordingly, the amount of water required to dilute the dispersion to a solids content of about 40% is increased.

Properties of the resin melt preparation prior to the dispersing:

| | |
|---|---|
| Epoxy equivalent weight (potentiometric): | 525 g/eq |
| Brookfield viscosity at 60° C.: | 247,000 mPas |
| Glass transition temperature (DSC): | 1° C. |
| Properties of the resulting aqueous dispersion: | |
| Solids content: | 39.8% by weight |
| Particle size distribution (laser light scattering): | 90% < 4.8 μm<br>50% < 3.1 μm<br>10% < 1.2 μm |
| Gravimetric stability of the dispersion 24 h after dilution with deionized water to 3% solids: | 96.5% |
| Tyndall effect: | slight |
| Appearance of a 15 μm thick film after drying: | slightly dull |
| Minimum film forming temperature of dispersion: | 15–17° C. |

EXAMPLE XIV

Example X is repeated, except that the resin melt preparation to be dispersed is composed of 72 parts of a diglycidyl ether of bisphenol A having an epoxy equivalent weight of 190 g/eq (Epikote 828 from Shell), 72 parts of a diglycidyl ether of bisphenol A having an epoxy equivalent weight of 475 g/eq (Epikote 1001 from Shell) 388 parts of a diglycidyl ether of bisphenol A having an epoxy equivalent weight of 870 g/eq Epikote 10004 from Shell) and 182 parts of the emulsifier described in Example I. The temperature of the resin melt preparation at the start of the dispersing is 75° C.

Properties of the resin melt preparation prior to the dispersing:

| | |
|---|---|
| Epoxy equivalent weight (potentiometric): | 735 g/eq |
| Brookfield viscosity at 60° C.: | 785,000 mPas |
| Glass transition temperature (DSC): | 1° C. |
| Properties of the resulting aqueous dispersion: | |
| Solids content: | 40.4% by weight |
| Particle size distribution (laser light scattering): | 90% < 1.8 μm<br>50% < 1.2 μm<br>10% < 0.6 μm |
| Gravimetric stability of the dispersion 24 h after dilution with deionized water to 3% solids: | 98.2% |
| Tyndall effect: | very pronounced |
| Appearance of a 15 μm thick film after drying: | clear, very bright |
| Minimum film forming temperature | 13–15° C. |

-continued

| | |
|---|---|
| of dispersion: | |

EXAMPLE XV

Example X is repeated, except that the emulsifier used therein is replaced by 95 parts of a polyethylene oxide/polypropylene oxide block copolymer of the approximate formula $$HO\text{-}(CH_2CH_2O)_2\text{-}(\underset{\underset{CH_3}{|}}{C}HCH_2O)_{16}\text{-}(CH_2CH_2O)_2\text{-}H$$

having a molecular weight, determined by vapor pressure osmometry, of 1070 g/mol (Pluronic L31 from BASF Corp.). After the amount of water required to effect a phase inversion from the water-in-oil emulsion into an oil-in-water emulsion has been dispersed in the resin melt preparation, the addition of further water to set the desired end concentration leads to the irreversible disintegration of the dispersion (emulsion breaking), and the polymer settles out in the form of a slime.

Properties of the resin melt preparation prior to the dispersing:

| | |
|---|---|
| Epoxy equivalent weight (potentiometric): | 380 g/eq |
| Brookfield viscosity at 60° C.: | 26,100 mPas |
| Glass transition temperature (DSC): | 6° C. |
| Properties of the resulting aqueous dispersion: | |
| Solids content: | — |
| Particle size distribution (laser light scattering): | — |
| Gravimetric stability of the dispersion 24 h after dilution with deionized water to 3% solids: | — |
| Tyndall effect: | — |
| Appearance of a 15 μm thick film after drying: | — |
| Minimum film forming temperature of dispersion: | — |

EXAMPLE XVI

Example X is repeated, except that the emulsifier used therein is replaced by 95 parts of the emulsifier prepared in Example III. The dispersion obtained is slightly yellowish.

Properties of the resin melt preparation prior to the dispersing:

| | |
|---|---|
| Epoxy equivalent weight (potentiometric): | 390 g/eq |
| Brookfield viscosity at 60° C.: | 25,000 mPas |
| Glass transition temperature (DSC): | |
| Properties of the resulting aqueous dispersion: | |
| Solids content: | |
| Particle size distribution (laser light scattering): | 90% < 2.5 μm<br>50% < 1.2 μm<br>10% < 0.6 μm |
| Gravimetric stability of the dispersion 24 h after dilution with deionized water to 3% solids: | 98.8% |
| Tyndall effect: | very pronounced |
| Appearance of a 15 μm thick film after drying: | clear, very bright |
| Minimum film forming temperature of dispersion: | 7–8° C. |

EXAMPLE XVII

Example X is repeated, except that the emulsifier used therein is replaced by 95 parts of the emulsifier prepared in Example IV.

Properties of the resin melt preparation prior to the dispersing:

| | |
|---|---|
| Epoxy equivalent weight (potentiometric): | 390 g/eq |
| Brookfield viscosity at 60° C.: | 29,000 mPas |
| Glass transition temperature (DS): | 0° C. |
| Properties of the resulting aqueous dispersion: | |
| Solids content: | 40.3% |
| Particle size distribution (laser light scattering): | 90% < 3.3 μm<br>50% < 1.6 μm<br>10% < 0.7 μm |
| Gravimetric stability of the dispersion 24 h after dilution with deionized water to 3% solids: | 93% |
| Tyndall effect: | very pronounced |
| Appearance of a 15 μm thick film after drying: | clear, very bright |
| Minimum film forming temperature of dispersion: | 9° C. |

EXAMPLE XVIII

Example X is repeated, except that the resin melt preparation to be dispersed is composed of 72 parts of a diglycidyl ether of bisphenol A having an epoxy equivalent weight of 190 g/eq (Epikote 828 from Shell), 72 parts of a diglycidyl ether of bisphenol A having an epoxy equivalent weight of 475 g/eq (Epikote 1001 from Shell), 388 parts of a diglycidyl ether of bisphenol A having an epoxy equivalent weight of 870 g/eq (Epikote 1004 from Shell) and 200 parts of the emulsifier described in Example IV. The temperature of the resin melt preparation at the start of the dispersing is 85° C.

Properties of the resin melt preparation prior to the dispersing:

| | |
|---|---|
| Epoxy equivalent weight (potentiometric): | 748 g/eq |
| Brookfield viscosity at 60° C.: | 800,000 mPas |
| Glass transition temperature (DSC): | 2° C. |
| Properties of the resulting aqueous dispersion: | |
| Solids content: | 40.6% |
| Particle size distribution (laser light scattering): | 90% < 3.7 μm<br>50% < 1.8 μm<br>10% < 0.8 μm |
| Gravimetric stability of the dispersion 24 h after dilution with deionized water to 3% solids: | 97.5% |
| Tyndall effect: | pronounced |
| Appearance of a 15 μm thick film after drying: | clear, bright |
| Minimum film forming temperature of dispersion: | 14–16° C. |

EXAMPLE XIX

Example XII is repeated, except that the emulsifier used therein is replaced by 160 parts of the emulsifier prepared in Example V.

Properties of the resin melt preparation prior to the dispersing:

| | |
|---|---|
| Epoxy equivalent weight: | 572 g/eq |
| Brookfield viscosity at 60° C.: | 18,300 mPas |
| Glass transition temperature (DSC): | −1° C. |
| Properties of the resulting aqueous dispersion: | |
| Solids content: | 38.1% |

-continued

| | |
|---|---|
| Particle size distribution (laser light scattering): | 90% < 1.6 μm<br>50% < 1.3 μm<br>10% < 0.8 μm |
| Gravimetric stability of the dispersion 24 h after dilution with deionized water to 3% solids: | 98.5% |
| Tyndall effect: | very pronounced |
| Appearance of a 15 μm thick film after drying: | clear, very bright |
| Minimum film forming temperature of dispersion: | 8° C. |

EXAMPLE XX

Example XII is repeated, except that the emulsifier used therein is replaced by 160 parts of the emulsifier prepared in Example VI. After the amount of water required for the phase inversion of the water-in-oil emulsion into an oil-in-water emulsion has been dispersed in the resin melt preparation, the addition of further water to set the desired end concentration causes the dispersion to disintegrate. Within 24 hours about 30% of the dispersed polymer settles out in the form of a slime.

Properties of the resin melt preparation prior to the dispersing:

| | |
|---|---|
| Epoxy equivalent weight: | 589 g/eq |
| Brookfield viscosity at 60° C.: | 14,300 mPas |
| Glass transition temperature (DSC): | −3° C. |
| Properties of the resulting aqueous dispersion: | |
| Gravimetric stability of the dispersion 24 h after dilution with deionized water to 3% solids: | <10% |
| Tyndall effect: | — |
| Appearance of a 15 μm thick film after drying: | — |
| Minimum film forming temperature of dispersion: | — |

EXAMPLE XXI (Comparison)

Example X is repeated, except that the emulsifier used therein is replaced by 95 parts (≈15%) of the emulsifier prepared in Example VII.

Properties of the resin melt preparation prior to the dispersing:

| | |
|---|---|
| Epoxy equivalent weight: | 382 g/eq |
| Brookfield viscosity at 60° C.: | 30,40 mPas |
| Glass transition temperature (DSC): | −1° C. |
| Properties of the resulting aqueous dispersion: | |
| Solids content: | 34.9% |
| Particle size distribution (laser light scattering): | 90% < 3.2 μm<br>50% < 2.0 μm<br>10% < 1.0 μm |
| Gravimetric stability of the dispersion 24 h after dilution with deionized water to 3% solids: | 90% |
| Tyndall effect: | pronounced |
| Appearance of a 15 μm thick film after drying: | clear, bright |
| Minimum film forming temperature of dispersion: | 8–10° C. |

EXAMPLE XXII (Comparison)

Example XIV is repeated, except that the emulsifier used therein is replaced by 182 parts (≈25.5%) of the emulsifier prepared in Example VII.

Properties of the resin melt preparation prior to the dispersing:

| | |
|---|---|
| Epoxy equivalent weight: | 750 g/eq |
| Brookfield viscosity at 60° C.: | 650,000 mPas |
| Glass transition temperature (DSC): | −1° C. |
| Properties of the resulting aqueous dispersion: | |
| Solids content: | 40.2% |
| Particle size distribution (laser light scattering): | 90% < 3.1 μm<br>50% < 1.7 μm<br>10% < 0.6 μm |
| Gravimetric stability of the dispersion 24 h after dilution with deionized water to 3% solids: | 87% |
| Tyndall effect: | very pronounced |
| Appearance of a 15 μm thick film after drying: | clear |
| Minimum film forming temperature of dispersion: | 11–13° C. |

EXAMPLE XXIII (Comparison)

Example XIV is repeated, except that the emulsifier used therein is replaced by 58 parts (≈10%) of a polyethylene oxide/propylene oxide block copolymer having a vapor pressure osmometry molecular weight of 10,060 g/mol (Pluronic F108 from BASF Corp.). The dispersion concentrate obtained close to the phase inversion point cannot be diluted by further addition of water. Two phases form.

Properties of the resin melt preparation prior to the dispersing:

| | |
|---|---|
| *Epoxy equivalent weight (potentiometric): | 690 g/eq |
| *Brookfield viscosity at 60° C.: | 890,000 mPas |
| *Glass transition temperature (DSC): | +10° C. |

EXAMPLE XXIV (Comparison)

Example X is repeated, except that the emulsifier used therein is replaced by 95 parts of the emulsifier prepared in Example VIII. The dispersion concentrate obtained close to the phase inversion point cannot be diluted by further addition of water. Phase separation takes place.

Properties of the resin melt preparation prior to the dispersing:

| | |
|---|---|
| Epoxy equivalent weight (potentiometric): | 397 g/eq |
| Brookfield viscosity at 60° C.: | 45,400 mPas |
| Glass transition temperature (DSC): | −5° C. |

Nor does the use of 235 parts of emulsifier of Example VIII give any dispersion.

EXAMPLE XXV (Comparison)

Example X is repeated, except that the emulsifier used therein is replaced by 95 parts of the emulsifier prepared in Example IX. The dispersion concentrate obtained close to the phase inversion point cannot be diluted by further addition of water. Phase separation takes place.

Properties of the resin melt preparation prior to the dispersing:

| | |
|---|---|
| Epoxy equivalent weight (protentiometric): | 393 g/eq |
| Brookfield viscosity at 60° C.: | 39,100 mPas |

-continued

| | |
|---|---|
| Glass transition temperature (DSC): | −2° C. |

TABLE 1

Number of parts of starting materials used in the synthesis of the emulsifiers as described in Examples I to IX

| Starting materials | I | II | III | IV | V | VI | VII | VIII | IX |
|---|---|---|---|---|---|---|---|---|---|
| Triton X100 | 1290 | — | 1290 | 1290 | 1290 | 1290 | 1290 | 1290 | 1290 |
| Ethylan BCP | — | 1239 | — | — | — | — | — | — | — |
| Tetrahydrophthalic anhydride | 600 | 600 | — | 600 | 600 | 600 | 600 | 600 | 600 |
| Maleic anhydride | — | — | 193 | — | — | — | — | — | — |
| Adipic acid | — | — | 288 | — | — | — | — | — | — |
| Epikote 828 | 760 | 760 | 760 | — | 760 | 760 | 760 | 760 | 760 |
| Epikote 1001 | — | — | — | 1800 | — | — | — | — | — |
| Pluronic F108 | 28000 | 28000 | 28000 | 28000 | — | — | — | — | — |
| Pluronic F68 | — | — | — | — | 16600 | — | — | — | — |
| Pluronic L31 | — | — | — | — | — | 2200 | — | — | — |
| Pluriol E6000 | — | — | — | — | — | — | 12000 | — | — |
| Pluriol E400 | — | — | — | — | — | — | — | — | 800 |
| Pluriol E200 | — | — | — | — | — | — | — | 400 | — |

The emulsifiers of Examples VI to IX are not according to the present invention.

TABLE 2

Physical properties of the emulsifiers of Examples I to IX and some comparative substances

| Emulsifier of Example | Molecular weight [g/mol]* | Melting point [°C.] | Viscosity [mPas]** | Hydrophilic group/ Hydrophobic groups [% by weight]*** |
|---|---|---|---|---|
| I | 17500 | 53–55 | 11800 | 36/64 |
| II | 15500 | 52–54 | 11100 | 36/64 |
| III | 12700 | 56–57 | | 35/65 |
| IV | 22700 | 54–56 | 18300 | 34/66 |
| V | 11500 | 47–49 | 4720 | 34/66 |
| VI | 1970 | — | 2460 | 4/96 |
| VII | 6040 | 57–58 | 5960 | 82/18 |
| VIII | 1380 | — | 1300 | 13/87 |
| IX | 1540 | — | 2130 | 23/77 |
| Pluronic L31 | 1070 | — | 32 | 17/83 |
| Pluronic F108 | 13600 | 56–58 | 10300 | 80/20 |

*by vapor pressure osmometry in chloroform
**at 60° C. by Brookfield
***ratio of terminating hydrophilic aliphatic groups (polyethylene oxide) to hydrophobic aliphatic or alkylaryl groups (calculated)

TABLE 3

Physical properties of the resulting aqueous dispersions

| Resin preparation | Dispersions X | XI | XII | XIII | XIV | XV | XVI | XVII |
|---|---|---|---|---|---|---|---|---|
| Epikote 828 | 170 | 170 | 100 | 100 | 72 | 170 | 170 | 170 |
| Epikote 1001 | 368 | 368 | 170 | 170 | 72 | 368 | 368 | 368 |
| Epikote 1004 | — | — | 265 | 265 | 388 | — | — | — |
| I | 95 | — | 95 | 160 | 182 | — | — | — |
| II | — | 95 | — | — | — | — | — | — |
| III | — | — | — | — | — | — | 95 | — |
| IV | — | — | — | — | — | — | — | 95 |
| V | — | — | — | — | — | — | — | — |
| VI | — | — | — | — | — | — | — | — |
| VII | — | — | — | — | — | — | — | — |
| VIII | — | — | — | — | — | — | — | — |
| IX | — | — | — | — | — | — | — | — |
| Pluronic L31 | — | — | — | — | — | 95 | — | — |
| Pluronic F108 | — | — | — | — | — | — | — | — |
| Epoxy equivalent weight [g/eq] | 390 | 388 | 525 | 585 | 735 | 380 | 390 | 390 |
| Glass transition temp. [°C.] | −3 | 0 | +1 | +1 | +1 | +6 | −3 | 0 |
| Viscosity [mPas]* | 25200 | 24000 | 24700 | 190000 | 785000 | 26100 | 29000 | (25000) |
| Stability [%]** | 98.8 | 98.5 | 96.5 | 99.2 | 98.2 | no | 93 | 98.8 |
| Particle size [μm]*** | 1.5 | 1.3 | 3.1 | 1.6 | 1.2 | dispersion possible | 1.6 | 1.2 |

| Resin preparation | Dispersions XVIII | XIX | XX | XXI[1] | $XXII_1$ | XXIII | XXIII | XXIII |
|---|---|---|---|---|---|---|---|---|
| Epikote 828 | 72 | 100 | 100 | 170 | 72 | 72 | 170 | 170 |

TABLE 3-continued

| Physical properties of the resulting aqueous dispersions | | | | | | | | |
|---|---|---|---|---|---|---|---|---|
| Epikote 1001 | 72 | 170 | 170 | 368 | 72 | 72 | 368 | 368 |
| Epikote 1004 | 388 | 265 | 265 | — | 388 | 388 | — | — |
| I | — | — | — | — | — | — | — | — |
| II | — | — | — | — | — | — | — | — |
| III | — | — | — | — | — | — | — | — |
| IV | 200 | — | — | — | — | — | — | — |
| V | — | 160 | — | — | — | — | — | — |
| VI | — | — | 160 | — | — | — | — | — |
| VII | — | — | — | 95 | 182 | — | — | — |
| VIII | — | — | — | — | — | 95 | — | — |
| IX | — | — | — | — | — | — | — | — |
| Pluronic L31 | — | — | — | — | — | — | — | — |
| Pluronic F108 | — | — | — | — | — | 58 | — | — |
| Epoxy equivalent weight [g/eq] | 748 | 572 | 589 | 382 | 750 | 690 | 397 | 393 |
| Glass transition temp. [°C.] | +2 | −1 | −3 | −1 | −1 | +10 | −5 | −2 |
| Viscosity [mPas]* | 800000 | 183000 | 143000 | 30400 | 650000 | 890000 | 45400 | 39100 |
| Stability [%]** | 97.5 | 98.5 | <10 | 90 | 87 | dispers. | dispers. | dispers. |
| Particle size [μm]*** | 1.8 | 1.3 | very coarse | 2.0 | 1.7 | coags. | coags. | coags. |

*at 60° C. by Brookfield
**gravimetric stability of dispersion 24 h after dilution to 3% solids
***median particle size (50% of the particles smaller than)
[1]emulsifier proved to be excessively hygroscopic, causing increased water absorption in the laminate

We claim:

1. A size for carbon fibers and glass fibers based on an aqueous dispersion, containing an epoxy resin and from 5 to 50% by weight, based on the epoxy resin, of an emulsifier, wherein the emulsifier is a polyester of the general formula $$A_1—B—A_2—B—A_3—H \quad (1)$$

where the symbols have the following meanings:

$A_1$ is the radical of a monoalcohol,

B is the radical of a dicarboxylic acid, $A_2$ is the radical of a diol and $A_3$ is the radical of a polyether diol and the polyester has a molecular weight of from 5,000 to 50,000.

2. A size as claimed in claim 1, wherein the symbols have the following meanings:

$A_1$ has the structure $$R_1—O—(CH_2—\underset{\underset{R_2}{|}}{CH}—O)_n,$$

where $R_1$ is aliphatic, aromatic or araliphatic hydrocyclyl of from 6 to 30 carbon atoms, $R_2$ is hydrogen or methyl and n is an integer from 0 to 30, B is the radical of a saturated or unsaturated, aliphatic, cycloaliphatic or aromatic dicarboxylic acid of from 2 to 20 carbon atoms, $A_2$ is the radical of a diol of from 10 to 60 carbon atoms which carries secondary OH groups, and $A_3$ is the radical of a polyether diol of the structure $X_p—Y_q—Z_r$ where $X=(CH_2—CH_2—O)$ $$Y=(CH_2—\underset{\underset{CH_3}{|}}{CH}—O)$$

$Z=(CH_2—CH_2O)$ p=50–200 q=0–100 r=0–200, the radical X forming the chain end.

3. A size as claimed in claim 2, wherein the weight ratio of $(A_1+B+A_2+Y+Z):X$ is from 80:20 to 40:60.

4. A size for carbon fibers based on an aqueous dispersion, containing an epoxy resin and from 5 to 50% by weight, based on the epoxy resin of a polyester having a molecular weight of from 5,000 to 50,000 of the general formula M—X—H, where M is a hydrophobic moiety and X—H is a hydrophilic polyethylene oxide moiety, wherein the weight ratio of M:X is from 80:20 to 40:60.

5. A size as claimed in claim 1 or 4, wherein the epoxy resin is a polyglycidyl ether of an aromatic polyalcohol having an epoxy equivalent weight of from 100 to 1,500 g/eq.

6. A carbon fiber which has been sized with from 0.3 to 10% by weight of an epoxy resin and an emulsifier as claimed in claim 1 or 4.

7. A glass fiber which has been sized with from 0.3 to 10% by weight of an epoxy resin and an emulsifier as claimed in claim 1 or 4.

* * * * *

UNITED STATES PATENT AND TRADEMARK OFFICE

CERTIFICATE OF CORRECTION

PATENT NO. : 5,063,261

DATED : November 5, 1991

INVENTOR(S) : Joerg Kroker and Silvio Vargiu

It is certified that error appears in the above-identified patent and that said Letters Patent is hereby corrected as shown below:

Col. 16, claim 2, line 34, change $Z=(CH_2- CH_2O)$ to $Z=(CH_2 -CH_2- O)$.

On the title page, [75]Inventors: Joerg Kroker, is of Neustadt, Federal Republic of Germany and not of Italy.

Signed and Sealed this

Twentieth Day of April, 1993

*Attest:*

*Attesting Officer*

MICHAEL K. KIRK

*Acting Commissioner of Patents and Trademarks*